US005699943A

United States Patent [19]

Schaefer et al.

[11] Patent Number: 5,699,943

[45] Date of Patent: Dec. 23, 1997

[54] BELT-MOUNTED FLASHLIGHT HOLDER

[75] Inventors: Roger W. Schaefer, San Luis Obispo; Michael Capanna, Nipomo; James D. Scott, Paso Robles, all of Calif.

[73] Assignee: Centurion Safety Products, Inc., San Luis Obispo, Calif.

[21] Appl. No.: 575,061

[22] Filed: Dec. 19, 1995

Related U.S. Application Data

[60] Provisional application No. 60/003,151, Sep. 1, 1995.

[51] Int. Cl. [6] ..... A45F 5/00

[52] U.S. Cl. ..... 224/197; 224/242; 224/247; 224/674; 224/678; 224/914; 16/342; 16/335; 24/516; 24/541; 248/316.2; 362/108

[58] Field of Search ..... 224/914, 197, 224/198, 199, 200, 247, 248, 674, 675, 678, 242, 251, 584; 248/316.2, 316.3, 316.5, 231.31, 230.2; 362/108; 16/342, 341, 334, 335; 24/516, 541

[56] References Cited

U.S. PATENT DOCUMENTS

| | | | |
|---|---|---|---|
| 1,318,850 | 10/1919 | De Young | 224/197 |
| 1,858,144 | 5/1932 | Fariello | 248/316.2 |
| 4,214,688 | 7/1980 | Griffin, Jr. | 224/197 |
| 4,536,925 | 8/1985 | Boothe et al. | 24/3.11 |
| 4,736,921 | 4/1988 | Zane et al. | 248/316.2 |
| 5,109,572 | 5/1992 | Park | 16/341 |
| 5,190,390 | 3/1993 | Ming-Tai | 16/334 |
| 5,277,346 | 1/1994 | Stier | 248/316.2 |
| 5,449,104 | 9/1995 | Parsons et al. | 224/245 |
| 5,452,497 | 9/1995 | Peng | 224/197 |

FOREIGN PATENT DOCUMENTS

| | | | |
|---|---|---|---|
| 367552 | 2/1932 | United Kingdom | 16/341 |

*Primary Examiner*—Linda J. Sholl
*Attorney, Agent, or Firm*—Daniel C. McKown

[57] ABSTRACT

A belt-mounted flashlight holder includes a belt loop subassembly and a cradle subassembly that are pivotally connected to permit the mounted flashlight to be rotated to any of several detented rotational positions. The cradle subassembly can accommodate flashlights or batons of various diameters within a reasonable range and includes a flexible removable jaw that is forced by a cam against the barrel of the flashlight so that the elastic restoring forces in the movable jaw provide the force that retains the flashlight in the cradle. The flexibility of the movable jaw and cradle permits the flashlight to break away from the cradle in which it is held if the flashlight is jerked by an assailant or if the flashlight becomes caught on an object. The cam includes a high spot that renders it stable in both the locked and released positions. The belt loop subassembly includes provision for mounting the flashlight holder on a wall or other reasonably flat surface.

6 Claims, 4 Drawing Sheets

BELT-MOUNTED FLASHLIGHT HOLDER

BACKGROUND OF THE INVENTION

1. Reference to Related Application

This application claims the benefit under 35 U.S.C. §119 (e) of U.S. Provisional Application No. 60/003,151 filed Sep. 1, 1995.

2. Field of the Invention

The present invention is in the field of flashlights and more particularly relates to a device that can be secured onto a police officer's belt for the purpose of holding a flashlight, a baton, or similar cylindrical object. When not in use on the belt, the device, along with the flashlight, can be mounted on a wall or on a panel or dashboard of a vehicle.

3. The Prior Art

The development of belt-mounted flashlight holders can be traced back at least as far as U.S. Pat. No. 1,318,850 issued Oct. 14, 1919 to DeYong. That patent describes an article that clips onto a belt, that includes a ratchet for holding the flashlight at various rotational positions with respect to the clip, and that includes a metal strap that encircles the flashlight to removably connect it to the article. DeYong's device does not include means for quickly attaching and detaching the flashlight, preferably with one hand. Further, short of removing the entire device from the belt, there is no provision that would permit the flashlight to break away from the device in the event the flashlight becomes caught on some object or in the event the flashlight is seized by an assailant.

Other early flashlight holders include U.S. Pat. No. 1,403,707 issued Jan. 17, 1922 to Quarnstrom and U.S. Pat. No. 1,405,630 issued Feb. 7, 1922 to Rosenfeld. In Quarnstrom's invention, the flashlight is clampingly embraced by resilient arms, and the flashlight may be rotated about an axis that is tangent to the belt to any of a number of detented positions. In Rosenfeld's invention, the cylindrical body of the flashlight is riveted to the holder.

In U.S. Pat. No. 5,255,168 issued Oct. 19, 1993, Stevens shows a different type of rotational detenting mechanism.

In U.S. Pat. No. 4,953,769 issued Sep. 4, 1990 and No. 4,955,518 issued Sep. 11, 1990 Parsons et al. show a baton clip in which the baton is retained by a strap that encircles it and in which the strap is secured by a snap fastener.

Further examples of the use of a resilient clip to hold a flashlight or similar tool are shown in U.S. Pat. No. 4,214,688 issued Jul. 29, 1980 to Griffin, Jr. and in U.S. Design Pat. No. 293,856 issued Jan. 26, 1988 to Evans.

In U.S. Pat. No. 3,792,829 issued Feb. 19, 1974, Fickett shows a fishing rod holder that includes a movable jaw that is held closed by a retainer that must be moved to a second position to unlock the fishing rod.

As may be seen from the above patents, a number of inventors have attempted through the years to devise a flashlight holder having the most useful combination of features. However, each of the earlier devices seemed to lack some desirable feature or contain some undesirable aspect. Therefore the present inventors, themselves law enforcement officers, set out to create a belt-mounted holder for a flashlight that would respond to the many functional demands faced in the course of contemporary law enforcement activities.

SUMMARY OF THE INVENTION

A popular type of service flashlight used by law enforcement officers is the MAG-LITE® flashlight. MAC-LITE® is a registered trademark of Mag Instrument, Inc. of Ontario, Calif. This flashlight includes a cylindrical barrel that is approximately 1.5 inches in diameter and 13 inches long. The optical portion of the flashlight is contained in an enlarged head located at one end of the cylindrical barrel. The flashlight weighs approximately 2.5 pounds including the batteries that are contained in the cylindrical barrel. One version of the holder of the present invention is designed to accommodate this rugged heavy-duty flashlight. Smaller versions will be produced for use with smaller flashlights, as well as the majority of law enforcement batons.

Based on their many years as law enforcement officers, the present inventors were able to compile a number of desirable features that an ideal belt-mounted flashlight holder should have. These will be discussed in the following paragraphs which also indicate briefly the structural means by which the desired features are implemented.

The present invention instantly secures and releases the flashlight, and this is a one-handed operation requiring a minimum of attention by the officer. It is possible for the officer to release the flashlight from the holder without having to divert his or her eyes from watching the situation at hand; the releasing and attaching of the flashlight is accomplished by touch only, and the process is so simple it can be done instinctively and in close quarters.

In a preferred embodiment of the present invention, this is accomplished by the use of a cam-actuated movable jaw. The movable jaw is held in a retaining position after one side of a cam has been pushed, and the movable jaw is released from its retaining position after the other side of the cam has been pressed. In the preferred embodiment, the cam is bistable in its locked and released positions, and the locking and releasing are accomplished by push-button actions.

This locking and unlocking arrangement allows the officer to have one hand free at all times and allows the officer to lock and unlock the flashlight in the dark and without having to look at the flashlight holder.

A second desirable feature of the flashlight holder is to permit rotation of the flashlight with respect to the belt to a number of detented rotational positions. In accordance with a preferred embodiment of the invention, the flashlight can be rotated 360 degrees in either direction, and the device provides eight different detented rotational positions. This permits the flashlight to be turned to one of the detented positions where it will resist unintended rotations, so that the flashlight will remain pointed in a particular direction without having to be held. This hands-free operation permits the officer to manipulate other tools as required. The rotational feature is highly useful where the officer has to frequently get in and out of a patrol car. The length of the barrel of the flashlight necessitates that it be rotated to permit the officer to sit comfortably when the flashlight is attached to the officer's belt by the holder.

In accordance with the present invention, a detented rotation is implemented through the use of an octagonal cam that operates against the urging of leaf springs located on opposite sides of the octagonal cam. The flat spots on the octagonal cam correspond to the detented rotational positions.

A third highly desirable feature results from the resolution of an apparent dilemma. In view of the weight of the flashlight and the normal forces acting on it, it is desirable that the holder should securely retain the flashlight at all times so that it doesn't accidentally become dislodged. On the other hand, it is desirable that the flashlight should break free from the holder in the event an assailant grabs the flashlight and attempts to use it to jerk the officer around.

In the preferred embodiment, this feature is implemented by making the movable jaw that holds the flashlight in its cradle stiff but sufficiently resilient to release the flashlight when the force applied to it exceeds a predetermined level which is approximately 80 pounds in a preferred embodiment.

A fourth desirable feature is that when the holder has been removed from the belt, the holder may be removably mounted on a wall or on a dashboard or panel of a vehicle, where it holds the flashlight ready for use.

In the preferred embodiment this is implemented by providing two keyhole-shaped slots on the back of the holder to engage the heads of two screws that extend out of the mounting surface.

A fifth desirable feature is that, unlike many prior art holders, the holder of the present invention will accommodate flashlights that have been outfitted with a non-slip rubber or vinyl sleeve on the barrel of the flashlight. Such a sleeve dramatically improves the user's grip on the flashlight and also permits an officer to hold the flashlight under his or her armpit while using both hands to perform other tasks.

The two most widely used devices for carrying a flashlight or baton are: first, a belt-mounted ring of metal, nylon, or leather, and second, the use of what is referred to as a sap pocket in the rear of the trouser for the flashlight. Neither of these two devices will accommodate the use of a rubber sleeve due to the binding on the ring or turning the sap pocket inside out whenever the flashlight is withdrawn. These methods make the flashlight or baton equally accessible to a second party as well as providing a handle to grab and swing the wearer around throwing the wearer off balance and making the wearer vulnerable to being overpowered if attacked. They also allow the flashlight or baton to swing and bounce while the wearer is running, making noise and in some cases allowing them to fall out without the wearer's knowledge. In most cases, the ring requires two hands to resecure the flashlight or baton.

A sixth desirable feature is that the present invention must be composed of materials that are lightweight, yet strong and durable in resisting cracking due to impacts and wear. In the preferred embodiment, this desirable feature is obtained by making the device of three high quality materials: KEVLAR® carbon fiber filled nylon, glass filled nylon, and stainless steel finished with a black oxide. KEVLAR® is a registered trademark of E.I. DuPont de Nemours, and Co. In other embodiments, some of the parts are composed of aluminum.

The above-described features of the present invention and their structural implementation will be described in greater detail in the following section in connection with the drawings. It should be remembered however that the drawings are for the purpose of illustration and description and are not intended to limit the scope of the invention.

DETAILED DESCRIPTION OF THE PREFERRED EMBODIMENT

Figure 1:
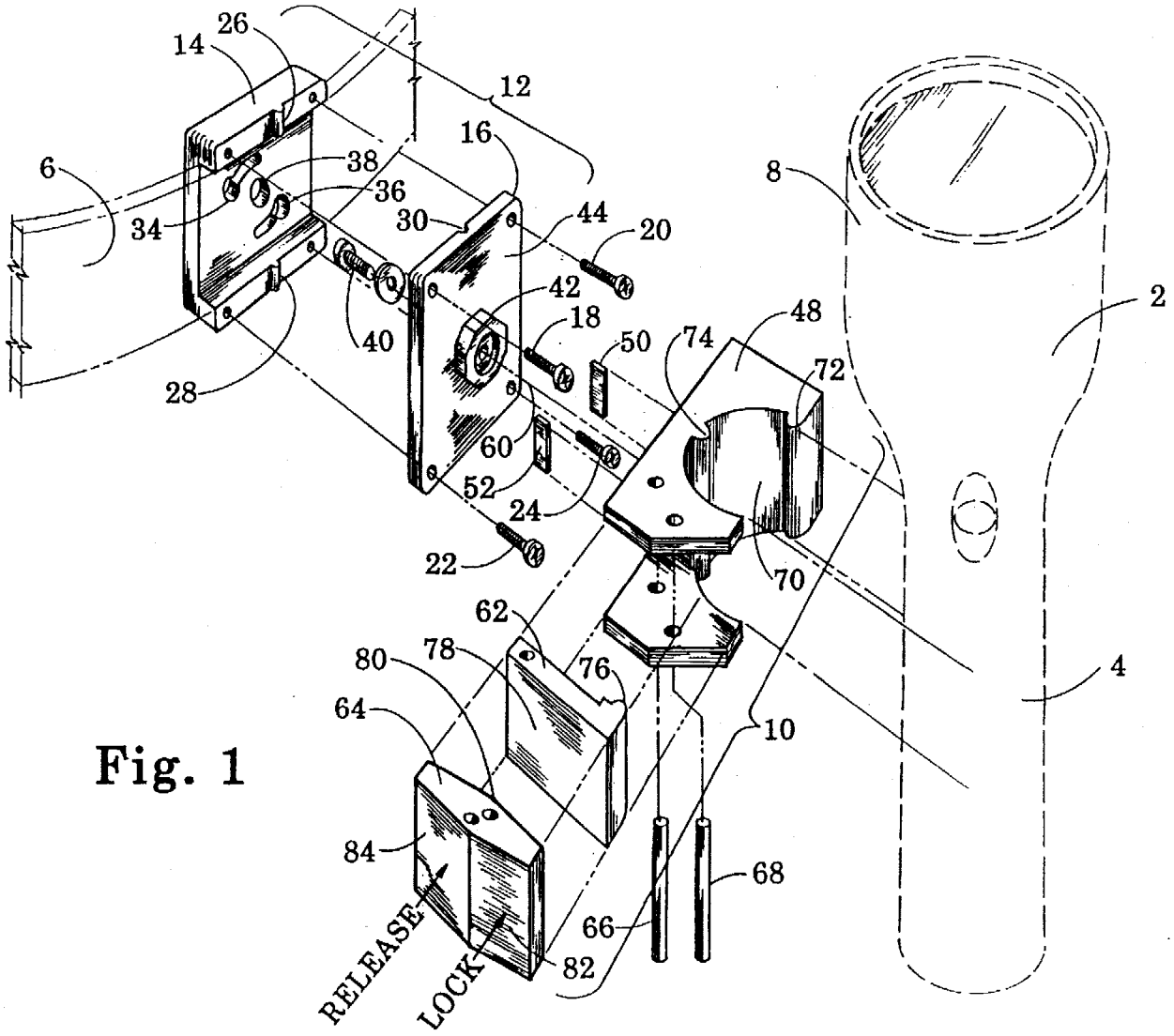
FIG. 1 is an exploded front top right perspective view of a preferred embodiment of the holder of the present invention.

The main purpose of the present invention is to hold a flashlight 2 having a cylindrical barrel 4 to a belt 6 that encircles the waist of a police officer or outdoors person. In the drawings, both the flashlight and the belt are shown in phantom lines. The device consists of two main subassemblies: a cradle subassembly 10 and a belt loop subassembly 12.

The belt loop subassembly 12 includes a back 14 and a front 16, which are held together in registration by the screws 18, 20, 22, and 24. Protrusions 26 and 28 on the back 14 fit into grooves 30 and 32 on the front to assist in bringing the back 14 and the front 16 into registration during assembly.

The back 14 includes a pair of keyhole apertures 34 and 36 that are used for receiving and retaining the heads of two screws (not shown) that extend out from a surface to which the device might be mounted when it is not worn on the belt. For example, the device could be mounted on a vertical wall or on a panel of a vehicle. In this connection, it is noteworthy that together the cradle subassembly 10 and the belt loop subassembly 12 extend forward sufficiently from the back 14 to provide clearance for the head portion 8 of the flashlight when the device is mounted on a vertical surface.

When the belt loop subassembly 12 is assembled by inserting and tightening the screws 18, 20, 22 and 24, the back 14 and the front 16 define a lateral passage through the belt loop assembly through which the belt 6 is passed when the device is to be attached to a belt. An access hole 38 is provided in the back 14 to facilitate the tightening of the screw 40 when the device is being assembled and before the belt is inserted. The screw 40 retains the cradle subassembly 10 to the belt loop subassembly 12.

The belt loop subassembly 12 is composed of 35 percent glass-filled nylon and is formed by a molding technique.

Figure 2:
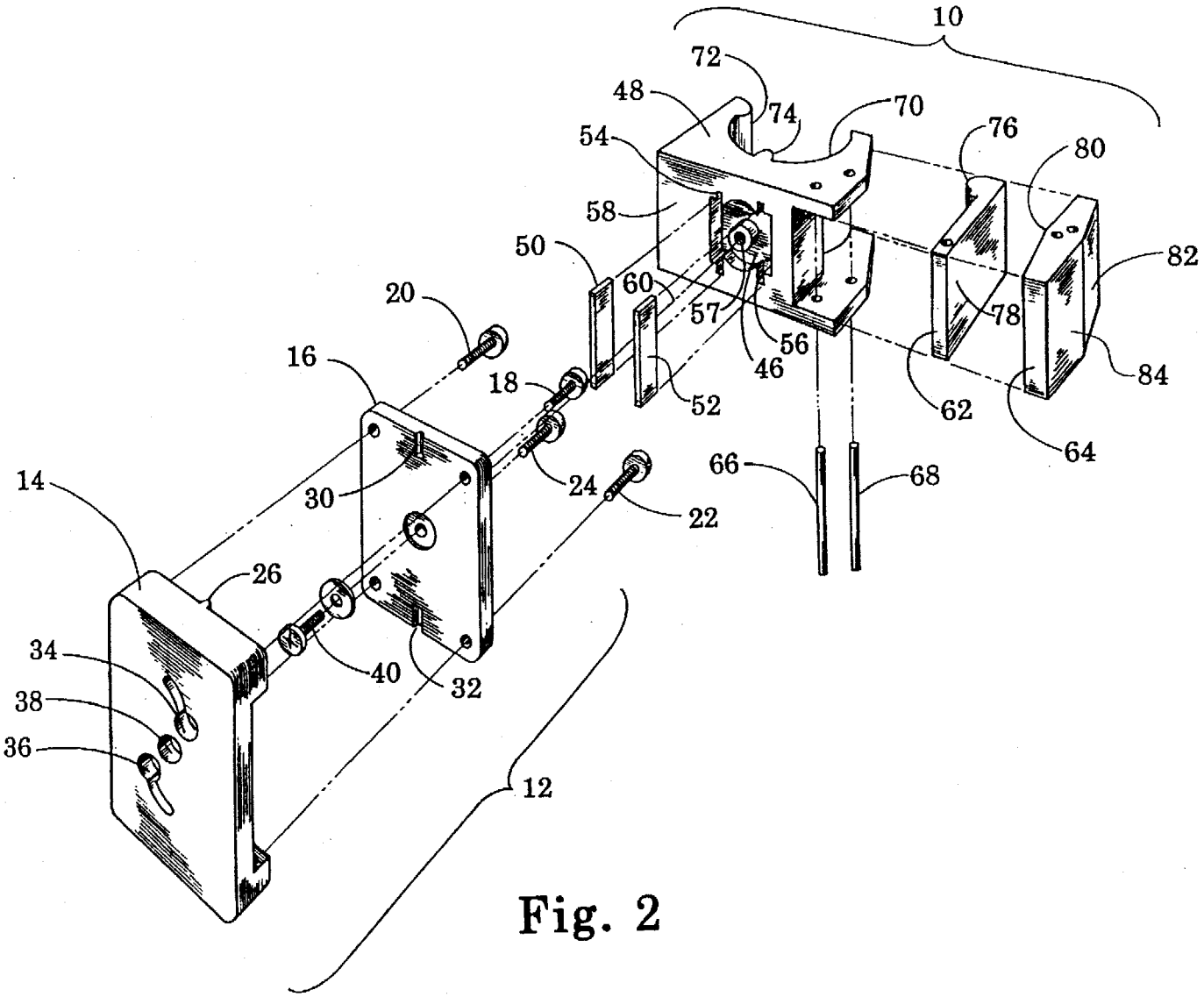
FIG. 2 is an exploded rear top right perspective view of the holder of FIG. 1.

As best seen in FIG. 1, an octagonal protrusion 42 extends forward above the generally planar front surface 44 of the front 16. This octagonal protrusion 42 extends into a cavity 46 (best seen in FIG. 2) in the back of the cradle 48, where the protrusion 42 is clamped between the leaf springs 50 and 52 that are retained in slots 54 and 56 that form part of the cavity 46. As the screw 40 is tightened into the threaded boss 57, the octagonal protrusion 42 is drawn into the cavity 46, so that when the device has been assembled, the front surface 44 of the front 16 is in close proximity to the rear surface 58 of the cradle 48. In the preferred embodiment the leaf springs 50 and 52 are composed of a non-flowing plastic.

The spacing between the slots 54 and 56 is such that the leaf springs 50 and 52 are elastically deformed to a small extent when the cradle 48 is at the rotational position shown in the drawings with respect to the belt loop subassembly. The same is true when the cradle has been rotated from the position shown in the drawings through angles of 45, 90, 135, 180, . . . degrees about the axis 60. These are the detented positions of the cradle 48 with respect to the belt loop subassembly 12, and these positions correspond to the flats on the octagonal protrusion 42. A deliberately applied force is required to turn the cradle subassembly 10 about the axis 60 from one of the detented positions to the other, because the corners on the octagonal protrusion 42 are at a greater radial distance from the axis 60 than are the flats, and accordingly, the leaf springs 50 and 52 must be forced aside by the corners of the octagonal protrusion in passing from one detented position to the next. To minimize wear, the corners of the octagonal protrusion 42 are slightly rounded in a preferred embodiment.

This rotational detenting mechanism for the cradle is noteworthy because it allows the flashlight to be set in any of eight detented rotational positions so that the user can continually illuminate a work area while having the benefit of being able to have both hands free. Further, the detenting mechanism prevents the flashlight, or a baton, from flopping or swinging while the user is running or walking. It also allows the flashlight or baton to be rotated while remaining locked in the cradle, so that the user can be comfortably seated in a chair or a vehicle while still retaining positive possession of the flashlight or baton if it should become necessary to leave the seated position quickly.

Finally, the rotational detenting mechanism permits the holder to be worn at either the user's right side or left side, and after the side has been chosen, the user may choose to locate the locking and releasing cam 64 on either side of the flashlight, simply by rotating the cradle 48 through 180 degrees. In this way the holder can be adjusted to the most natural-feeling position for both left-handed and right-handed users.

In the preferred embodiment, the protrusion 42 is octagonal because it is desirable to provide detented positions in 45 degree increments. In other embodiments it may be desired to provide detented positions having a different angular spacing. This can be accomplished by using a protrusion having 4, 6, 10, 12 or some other even number of sides.

The cradle subassembly 10 not only holds the flashlight or baton, but in addition performs two other extremely useful functions. First, the cradle subassembly 10 provides means for instantaneously securing and releasing the flashlight or baton in close or cramped quarters. Second, the cradle subassembly 10 is designed to permit the flashlight or baton to break away from the cradle in the rare event the flashlight is strongly pulled away from the cradle 48. In the event an assailant grabs the secured flashlight or baton and attempts to overpower the wearer by swinging the wearer around and throwing the wearer off balance, these actions are frustrated because the flashlight or baton simply comes loose from the cradle 48 when sufficient force is applied, allowing the wearer to concentrate on retaining his or her balance and on retaining his or her primary weapon, the firearm. This gives the wearer an opportunity to protect himself or herself from a position of advantage rather than from a disadvantageous overpowered position.

The break-away feature is also valuable when the flashlight or baton accidently becomes caught on a seatbelt, fence or similar object. The following description will show how these desirable functions are a result of the structural design of the cradle subassembly 10.

The cradle subassembly 10 includes the cradle 48, a movable jaw 62, a cam 64, a pin 66 about which the movable jaw pivots, and a pin 68 about which the cam pivots. The cradle 48 is composed of a 35 percent glass-filled nylon and is formed by molding. The movable jaw 62 and the cam 64 are composed of KEVLAR® carbon fiber-filled nylon in the preferred embodiment. Not only are the materials strong, shock-resistent, and wear-resistant, but in addition, they are sufficiently elastic to provide a desired locking preload and to provide sufficient elastic deformation of both the cradle 48 and the movable jaw 62 in response to a strong applied load to permit the flashlight to break away from the cradle when tugged by an assailant. It is noteworthy that these features could not be achieved if the inventors followed their initial impulse of making the device as rigid as possible. Unexpectedly, many desirable advantages flow from designing a moderate degree of flexibility into the cradle subassembly.

One of the first problems confronting the present inventors was the indisputable fact that not all flashlights and batons are of the same diameter. There is no standard diameter for such parts, and although the actual diameter is loosely determined by the diameter of the batteries used in the flashlight, nevertheless variations in diameter are the rule rather than the exception. Thus, if the inventors had followed their first impulse of providing the cradle 48 with a semicircular cavity of a particular diameter, they would have found that flashlights of larger and smaller diameters would have fitted poorly into the cavity. Instead, the inventors adopted a more innovative approach, as best seen in FIG. 1.

The cradle 48 is provided with a cavity 70 that is generally semicircular in shape but which has a diameter that is greater than any of the flashlights and batons that must be accommodated. Next, the inventors provided two ridges 72 and 74 that extend into the cavity and that run parallel to the axis of the flashlight. The strategy of the inventors is that a flashlight of any diameter (within a reasonable range) rests against the ridges 72 and 74 and is retained against those ridges by a force exerted by a similar ridge 76 on the movable jaw 62. The ridge 76 does not merely lightly contact the barrel of the flashlight or baton, but instead continually exerts a strong force against the barrel 4 of the flashlight, forcing it against the ridges 72 and 74 of the cradle. The strong force is in fact the elastic restoring force that results from elastic deformation of the cradle 48 and of the movable jaw 62 by the cam 64 when the cam has been pivoted to the locked position. Thus, it is seen that the flexing of the movable jaw 62 permits the cradle subassembly to accommodate flashlights and batons having a range of diameters. The larger diameter ones are held more tightly than the smaller diameter ones, but the parts are designed so that even the smaller diameter flashlights and batons are held with at least a specified force.

When the barrel 4 of the flashlight is strongly pulled in the direction of the axis 60, the elastic restoring force is overcome and the movable jaw is deformed even further (but well within its elastic limit) permitting the flashlight to be pulled out of the cradle in a break-away situation.

The design approach taken by the inventors has the further advantage of being able to accommodate flashlights on which a rubber or vinyl sleeve has been drawn over the barrel to provide a more secure grip. Care is taken that the grip sleeve does not cover that part of the barrel which the cradle and movable jaw contact.

The purpose of the cam 64 is to apply, in the locked position, sufficient force to the back 78 of the movable jaw 62 to cause the ridge 76 to bear against the barrel of the flashlight with considerable force. In the released position, the cam must permit the movable jaw 62 to pivot about the pin 66 away from the barrel of the flashlight. Any specific cam design or shape that will accomplish these results is considered to be within the scope of the present invention. The drawings show the shape of the cam used in a preferred embodiment of the present invention.

In the preferred embodiment of the invention, the cam 64 includes a ridge 80 that runs parallel to the pin 68 and that bears against the back 78 of the movable jaw. The ridge 80 acts as a "high spot" on the cam so that the cam is truly bistable in the sense that no amount of force exerted by the flashlight barrel on the ridge 76 of the movable jaw 62 can alter the locked or released state of the cam 64. Only the user can select the state of the cam, and this is done by pushing against the surface 82 toward the flashlight to pivot the cam to the locked position and by pushing against the surface 84 to pivot the cam to the released position. This simple push-button locking and release mechanism is extremely advantageous because it can be operated by touch and because it requires only one hand which happens to be the hand nearest the flashlight or baton. In this way, the user always has one hand free and can easily lock or release the flashlight even in the dark or in a cramped space.

Figure 3:
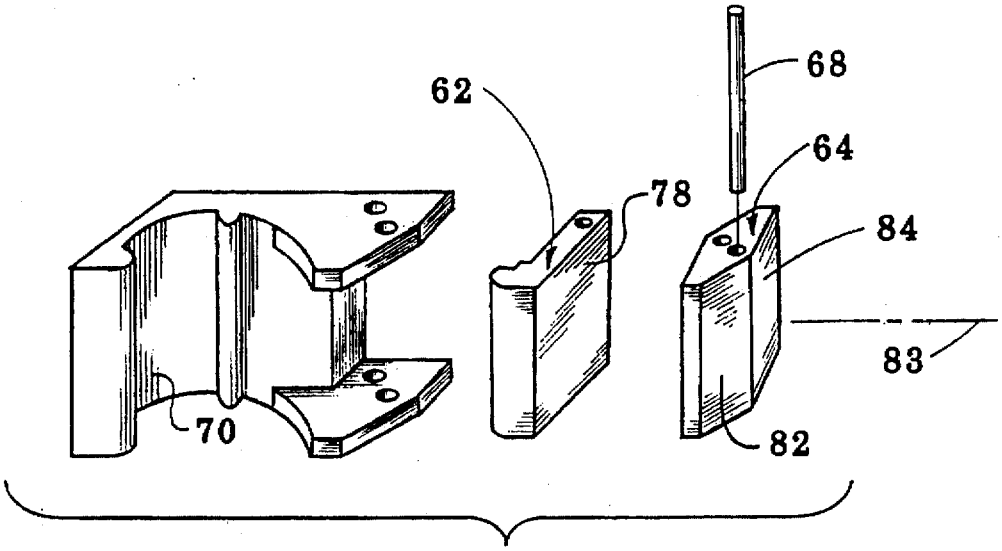
FIG. 3 is an exploded perspective view showing the cam, movable jaw, and cradle in a preferred embodiment, with the cam positioned to accommodate smaller flashlights or batons.
Figure 4:
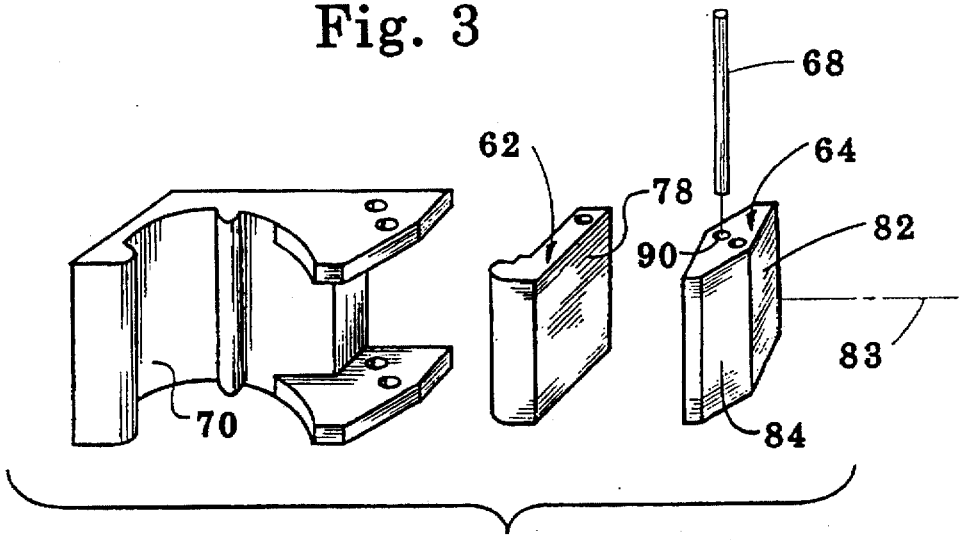
FIG. 4 is an exploded perspective view similar to that of FIG. 3, but with the cam positioned to accommodate larger flashlights or batons.

In order to accommodate an even greater range of flashlight or baton diameters, in the preferred embodiment the cam 64 is provided with a special shape as shown in FIGS. 3 and 4. The special shape, in effect, provides two cams in one. When the cam 64 is in the position indicated in FIG. 3, smaller flashlights can be accommodated; and, with the cam 64 and the position indicated in FIG. 4, larger flashlights can be held.

Referring to FIGS. 3 and 4, to alter the range of diameters, the user merely pushes the pin 68 out, rotates the cam 64 end-for-end 180 degrees about the horizontal axis 83, and then inserts the pin 68 through the alternative hole 90. In this second position, shown in FIG. 4, the surfaces 82 and 84 are reversed and the cam 64 is located farther from the back 78 of the movable jaw 62, thereby permitting the jaw 62 to swing open a little wider to accommodate the larger flashlights.

Figure 5:
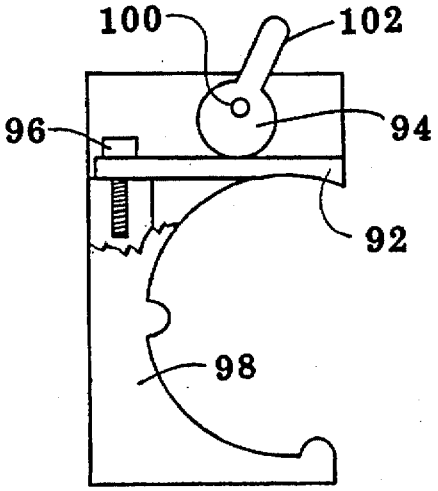
FIG. 5 is a top plan view showing the cradle, movable jaw, and cam in a first alternative embodiment of the flashlight holder.

A first alternative embodiment of the flashlight holder is shown in FIG. 5. In that embodiment, a movable jaw 92 is caused to flex from a released position to a locked position by the action of a cam 94.

In the embodiment shown in FIG. 5, the movable jaw 92 is fastened by screws, of which the screw 96 is typical, to the cradle 98. In a variation of this embodiment, the movable jaw 92 is formed as an integral part of the cradle 98. In the embodiment of FIG. 5, the cam 94 is a cylinder that is mounted off center within a portion of the cradle by the pin 100. The user rotates the cam 94 from the released to the locked position and vice versa by means of the handle 102.

Figure 6:
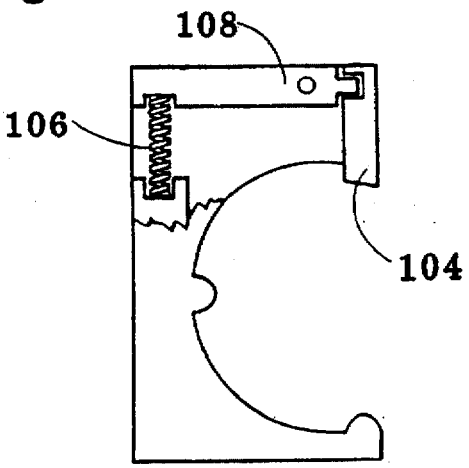
FIG. 6 is a top plan view showing the cradle and related parts in a second alternative embodiment of the flashlight holder.

FIG. 6 shows a second alternative embodiment of the flashlight holder. In this embodiment, a movable jaw 104 is maintained in a normally-locked position by a compression spring 106 that is coupled to the movable jaw 104 by a lever 108. The movable jaw 104 slides in a channel that is part of the cradle. To move the movable jaw to its released position, the user pushes on the lever 108 to compress the compression spring 106.

Figure 7:
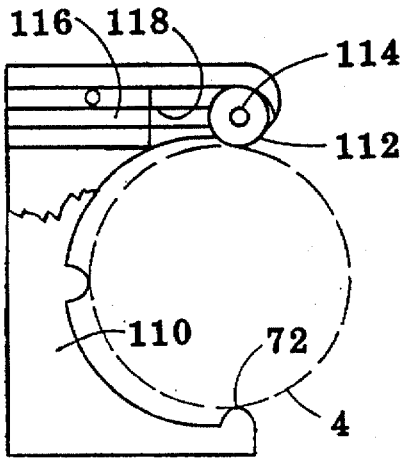
FIG. 7 is a top plan view showing the cradle and related parts in a third alternative embodiment of the flashlight holder.

FIG. 7 shows a third alternative embodiment of the flashlight holder that employs yet another technique for retaining the flashlight in the cradle 110. This embodiment makes use of a resilient cylindrical roller 112 having a coaxial cylindrical metallic core 114. The ends of the cylindrical metallic core 114 extend slightly beyond the ends of the resilient roller 112. The ends of the cylindrical metallic core 114 extend into linear grooves of which the groove 116 is typical. The length of the groove 116 is limited so that the roller 112 is always in contact with the cylindrical barrel 4 of the flashlight.

When the flashlight is to be inserted into the cradle for retention, the cylindrical barrel 4 of the flashlight is rotated by the user in a clockwise sense as viewed in FIG. 7. This causes the resilient roller to rotate in a counterclockwise sense and causes the metallic core 114 to roll along the outer wall 118 of the groove 116 to the right as viewed in FIG. 7. The deformation of the resilient roller increases as the full diameter of the cylindrical barrel 4 passes between the ridge 72 and the resilient roller 112. Further clockwise rotation of the cylindrical barrel 4 of the flashlight brings the resilient roller 112 and the flashlight barrel to the locked position shown in FIG. 7. Releasing of the flashlight is accomplished by rotating the cylindrical barrel 4 of the flashlight in a counterclockwise sense as viewed in FIG. 7.

Figure 8:
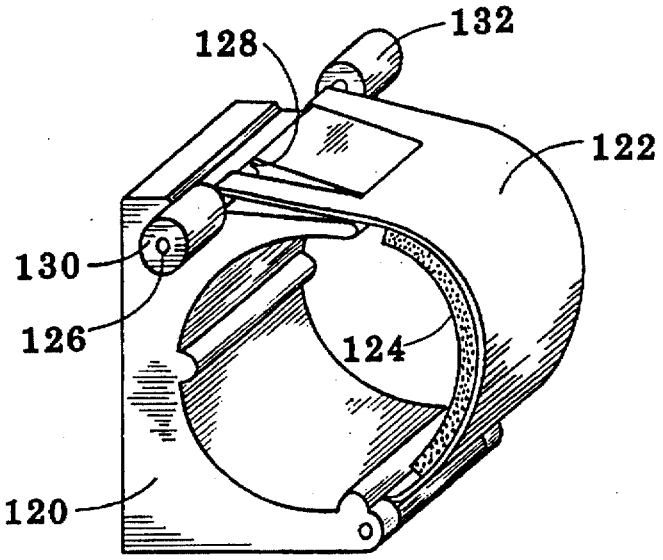
FIG. 8 is a top front left perspective view showing the cradle and related parts in a fourth alternative embodiment of the flashlight holder.

FIG. 8 shows a fourth alternative embodiment of the flashlight holder. In this embodiment, the flashlight or baton is secured within the cradle 120 by a band 122. In this embodiment, the band includes a sheet of metal. A portion of the band 122 facing the flashlight barrel is lined with a layer 124 of a resilient material, such as a soft rubber. At its free end, the band is provided with a metal rod 126 that extends laterally on both sides of the band. To secure the flashlight after it has been inserted into the cradle 120, the user brings the band around the flashlight, and draws against the free ends of the metal rod 126 until a center portion of the rod 126 clears a lip 128 that extends from the cradle 120. The layer 124 of resilient material makes it possible for the metal rod 126 to clear the lip 128 even though the band 122 does not change its length appreciably. For ease of handling, the ends of the metal rod 126 are provided with knobs 130 and 132.

FIGS. 9, 10, 11 and 12 relate to an alternative implementation of the rotational detenting mechanism. In this alternative embodiment, the rear surface 58 of the cradle 48 includes a recessed area or cavity 134 having the shape shown in FIG. 9. The perimeter 136 of this cavity 134 will be recognized as a circle from which eight semi-circular arcs of smaller radius protrude outward.

Figure 10:
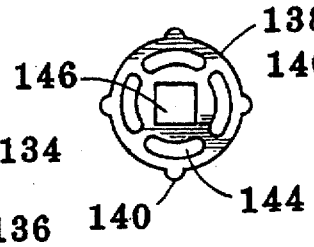
FIG. 10 is a front elevational view of a part used in the alternative implementation of FIG. 9.

FIG. 10 shows a separate part that, in use, is inserted into the cavity 134. The detent 138, shown in FIG. 10, includes four protrusions, of which the protrusion 140 is typical. Although four protrusions are used in the preferred embodiment, in other embodiments one or more protrusions may be used. A void region 144 lies radially inward of each protrusion 140 to permit resisted inward radial movement of the protrusion 140. A square hole 146 is centered at the center of the detent 138.

Figure 9:
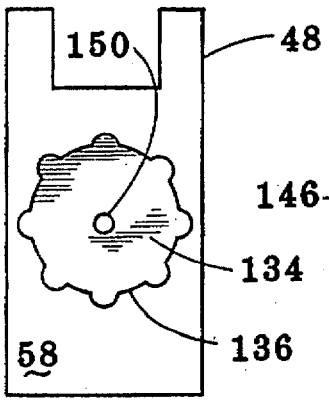
FIG. 9 is a front elevational view of the rear surface of the cradle in an alternative implementation of the rotational detenting mechanism.
Figure 11:
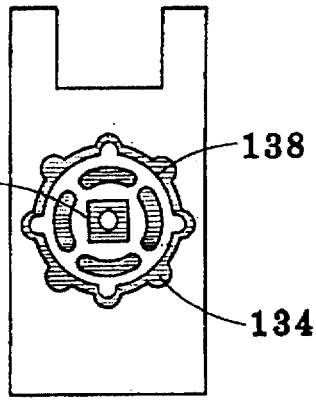
FIG. 11 is a front elevational view of the rear surface of the cradle of FIG. 9 with the part of FIG. 10 in place; and, FIG. 12 is a side elevational view of the belt loop subassembly used with the alternative implementation of the rotational detenting mechanism of FIGS. 9–11.

FIG. 11 shows the detent 138 of FIG. 10 inserted into the cavity 134 shown in FIG. 9.

Figure 12:
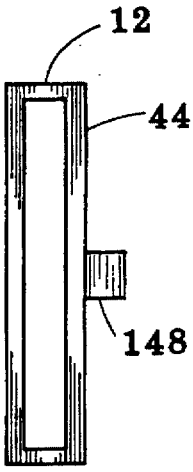

As shown in FIG. 12, a square protrusion 148 extends forward from the front surface 44 of the front of the belt loop subassembly 12. When the device is assembled, the square protrusion 148 extends into the square hole 146 and prevents the detent 138 from rotating. As in the embodiment shown in FIG. 2, the parts are held together by a screw that extends into a threaded bore 150 in the cradle 48. This arrangement of FIGS. 9–12 permits detented rotation of the cradle to any of eight angular positions with respect to the belt loop subassembly.

Thus, there has been described a belt-mounted flashlight holder that solves the problems associated with prior art flashlight holders and that provides a number of unique advantages. These include the ability to accommodate flashlights or batons of various diameters (including those covered by grip-enhancing sleeves), a push-button locking and release mechanism that can easily be operated with one hand, the provision for the flashlight to break away from the cradle when jerked by an assailant or when caught on an object, and the provision of means for mounting the flashlight holder on a wall or other relatively flat surface. The flashlight holder of the present invention permits the flashlight to be rotated to any of several detented rotational positions where it allows the user to have both hands free. The belt-mounted flashlight holder of the present invention is composed of high performance material throughout, which assures long life and reliable operation of the product.

The foregoing detailed description is illustrative of a preferred embodiment of the invention, and it is to be understood that additional embodiments thereof will be obvious to those skilled in the art. The embodiments described herein together with those additional embodiments are considered to be within the scope of the invention.

We claim:

1. A belt-mounted holder for releasably securing a cylindrical object having an axis to a belt, comprising:

a cradle including a surface that defines a cavity that partially surrounds the cylindrical object;

a movable jaw pivotably attached to said cradle, having a locked position and a released position, obstructing removal of the cylindrical object from the cavity when in the locked position and when in the released position permitting removal of the cylindrical object from the cavity in a direction perpendicular to the axis of the cylindrical object without deformation of said movable jaw or said cradle; and, a cam pivotably attached to said cradle and manually pivotable from a locked position to a released position and from the released position to the locked position, bearing against said movable jaw when in the locked position to oppose releasing movement of said movable jaw;

said cradle and said movable jaw possessing a degree of elasticity that permits the cylindrical object to be pulled from the cavity in a direction perpendicular to its axis by manual application of a predetermined amount of force when said cam and said movable jaw are in the locked position, without breaking or permanently deforming said cradle, said movable jaw, or said cam.

2. The belt-mounted holder of claim 1 wherein the surface of said cradle further comprises exactly two ridges that protrude into the cavity and that extend parallel to the axis of the cylindrical object so that cylindrical objects of smaller sizes can be held firmly against said exactly two ridges by said movable jaw when it is in a locked position.

3. The belt-mounted holder of claim 1 further comprising a pin pivotably attaching said cam to said cradle, and wherein said cam includes two parallel bores through which said pin may alternatively be inserted at the option of a user to permit said cam to be repositioned to accommodate cylindrical objects of different sizes.

4. The belt-mounted holder of claim 1 further comprising:

a belt loop subassembly;

an N-sided protrusion extending from said belt loop subassembly and having a cross section in the shape of a regular N-sided polygon, where N is an even number greater than two; and two parallel leaf springs located on opposite sides of said N-sided protrusion and spaced to bear snugly against opposite sides of said N-sided protrusion.

5. The belt-mounted holder of claim 4 wherein said cradle further includes a recess into which said N-sided protrusion extends and wherein said cradle further includes means for retaining said two parallel leaf springs in spaced relationship within said recess.

6. The belt-mounted holder of claim 4 wherein said belt loop subassembly further comprises a back having portions that define an aperture for permitting the belt-mounted holder to be removably mounted to other objects when not mounted on a belt.

* * * * *